US011415306B2

(12) United States Patent
Ye et al.

(10) Patent No.: US 11,415,306 B2
(45) Date of Patent: Aug. 16, 2022

(54) PANEL LIGHT APPARATUS

(71) Applicant: XIAMEN LEEDARSON LIGHTING CO., LTD, Fujian (CN)

(72) Inventors: Chuanbao Ye, Fujian (CN); Ruixiang Lin, Fujian (CN); Yunbiao Wu, Fujian (CN); Lei Zhang, Fujian (CN); Yongzhe Dong, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/391,637

(22) Filed: Aug. 2, 2021

(65) Prior Publication Data

US 2022/0049843 A1 Feb. 17, 2022

(30) Foreign Application Priority Data

Aug. 12, 2020 (CN) ..... 202021676120.0

(51) Int. Cl.

| | |
|---|---|
| ***F21V 23/00*** | (2015.01) |
| ***F21S 4/20*** | (2016.01) |
| ***F21V 23/04*** | (2006.01) |
| ***F21V 19/00*** | (2006.01) |
| ***F21S 8/04*** | (2006.01) |
| ***F21V 23/06*** | (2006.01) |
| *F21Y 115/10* | (2016.01) |

(52) U.S. Cl.

CPC ..... *F21V 23/007* (2013.01); *F21S 4/20* (2016.01); *F21S 8/04* (2013.01); *F21V 19/003* (2013.01); *F21V 23/04* (2013.01); *F21V 23/06* (2013.01); *F21Y 2115/10* (2016.08)

(58) Field of Classification Search

CPC ..... F21S 8/04; F21S 8/043; F21S 4/20; F21V 23/007; F21V 19/003

See application file for complete search history.

(56) References Cited

U.S. PATENT DOCUMENTS

| | | | | |
|---|---|---|---|---|
| 10,104,738 | B1 * | 10/2018 | Wang | H05B 45/46 |
| 2016/0329624 | A1 * | 11/2016 | Chen | F21V 3/00 |
| 2019/0234593 | A1 * | 8/2019 | Stevens | H01R 13/73 |

* cited by examiner

*Primary Examiner* — Karabi Guharay

(57) ABSTRACT

A panel light apparatus includes a base plate, a light source, a frame and a light passing cover. The base plate has a fixing unit for fixing the base plate to a platform. The base plate has multiple rotation units to switch between a lock mode and a release mode. The light source is disposed on the base plate. The frame has multiple attaching units to attach to the rotation units in the lock mode for fixing the frame to the base plate. The multiple attaching units are released from the rotation units in the release mode. The frame has a light opening. The light passing cover attached to the frame for covering the light opening for a light of the light source to pass through.

19 Claims, 8 Drawing Sheets

PANEL LIGHT APPARATUS

FIELD

The present invention is related to a panel light apparatus, and more particularly related to a panel light apparatus with an easy assembly structure.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Panel light devices are widely used in various places. Panel light devices have advantages of smaller size and large area of light output.

It is important to design a better way to clean panel light devices to increase the life span of such devices.

It is also important to keep the manufacturing cost as low as possible while providing more flexibility and convenience to users.

SUMMARY

In some embodiments, a panel light apparatus includes a base plate, a light source, a frame and a light passing cover.

The base plate has a fixing unit for fixing the base plate to a platform.

The base plate has multiple rotation units to switch between a lock mode and a release mode.

The light source is disposed on the base plate.

The frame has multiple attaching units to attach to the rotation units in the lock mode for fixing the frame to the base plate.

The multiple attaching units are released from the rotation units in the release mode.

The frame has a light opening.

The light passing cover attached to the frame for covering the light opening for a light of the light source to pass through.

In some embodiments, the base plate has a central groove for holding a driver.

In some embodiments, the base plate has a conductive path and a driver connector.

The driver is connected to the driver connector to electrically connected to an external power wire.

The external power wire and the driver are placed on opposite sides of the base plate.

In some embodiments, the driver has a manual switch for changing a setting of the driver.

In some embodiments, the manual switch has a rotation switch and a discrete switch.

The rotation switch is used for changing a continuous value and the discrete switch is used for setting a discrete value.

In some embodiments, the manual switch is concealed by the light passing cover.

In some embodiments, the base plate has multiple light grooves for disposing multiple light strips of the light source.

In some embodiments, the light groove has a reflective surface.

In some embodiments, the light strip has an electric insulation surface.

In some embodiments, the electric insulation surface includes a lens for diffusing a light of the light strip.

In some embodiments, the driver detects a number of connected light strips to automatically adjust an operation parameter.

In some embodiments, if the driver detects a failure light strip, the driver turns off the failed light strip and increases light intensities of other light strips.

In some embodiments, the light source has multiple light strips.

The light strip has an internal driver and a LED module.

The internal driver generates a separate driving current to the LED module.

In some embodiments, the base plate has multiple light strip connectors for attaching the light strip.

In some embodiments, the frame and the light passing cover are integrated as a replaceable module to be replaced by a user.

In some embodiments, the fame has a different geometric shape as the base plate.

In some embodiments, the base plate has multiple traditional light tube connectors for selectively connecting traditional light tubes as the light source or light strips with LED modules on the base plate as the light source.

In some embodiments, the base plate has an Edison socket for connecitng a light bulb.

In some embodiments, the driver turns off electricity when the rotation units are placed in the release mode.

In some embodiments, a temperature indicator is placed on the frame for indicating an alarm message when a working temperature is higher than a threshold.

DETAILED DESCRIPTION

Figure 5:
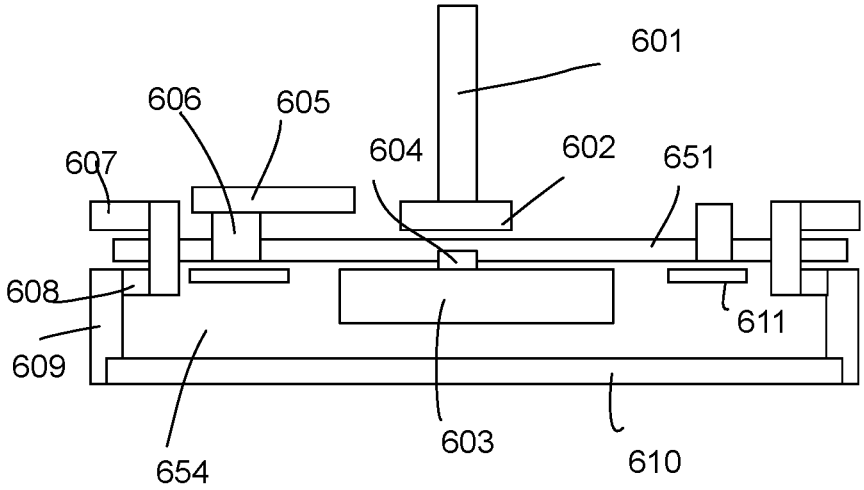
FIG. 5 shows another panel light apparatus embodiment.

In FIG. 5, a panel light apparatus includes a base plate 651, a light source 611, a frame 609 and a light passing cover 610.

The base plate 651 has a fixing unit 606 for fixing the base plate 651 to a platform 605.

The base plate 651 has multiple rotation units 607 to switch between a lock mode and a release mode.

Figure 8A:
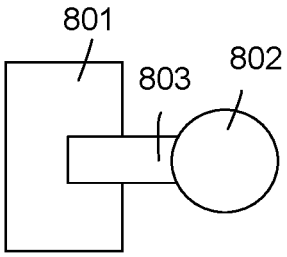
FIG. 8A and FIG. 8B show two modes of a rotation unit.
Figure 8B:
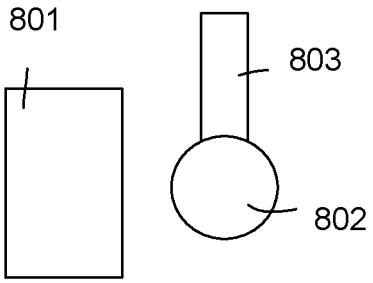

FIG. 8B shows that the rotation unit 802 is rotated to move the pin 803 to release the attaching unit 801 of the frame in a release mode.

In FIG. 5, the light source 611 is disposed on the base plate 651.

The frame 609 has multiple attaching units 608 to attach to the rotation units 607 in the lock mode for fixing the frame 609 to the base plate 651.

The multiple attaching units are released from the rotation units in the release mode.

FIG. 8A and FIG. 8B illustrate an example. In FIG. 8A, a rotation unit 802 has a pin 803. The pin 803 is moved by rotating the rotation unit 802 to engage and hold the attaching unit 801 of the frame 609 in a lock mode.

The frame 609 has a light opening 654.

The light passing cover 610 attached to the frame 609 for covering the light opening 654 for a light of the light source 611 to pass through.

Figure 6:
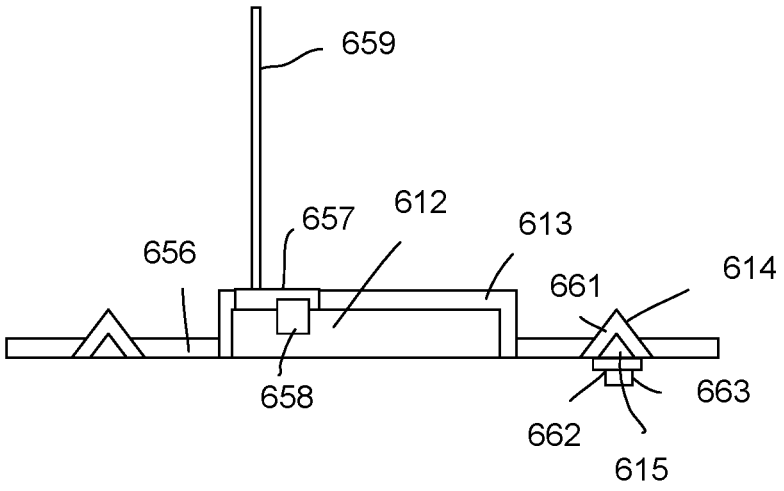
FIG. 6 shows a base plate example.

In FIG. 6, the base plate 656 has a central groove 613 for holding a driver 612.

In some embodiments, the base plate 656 has a conductive path 657 and a driver connector 658.

The driver 612 is connected to the driver connector 658 to electrically connected to an external power wire 659 via the conductive path 657. The conductive path 657 may include wire or metal layers for guiding electricity and signals among components.

The external power wire 659 and the driver 612 are placed on opposite sides of the base plate 656.

In FIG. 5, the external power wire 601 is connected to a connector 602 which further routes the electricity to the driver 603 via the connector 604.

In some embodiments, the driver has a manual switch for changing a setting of the driver.

Figure 7:
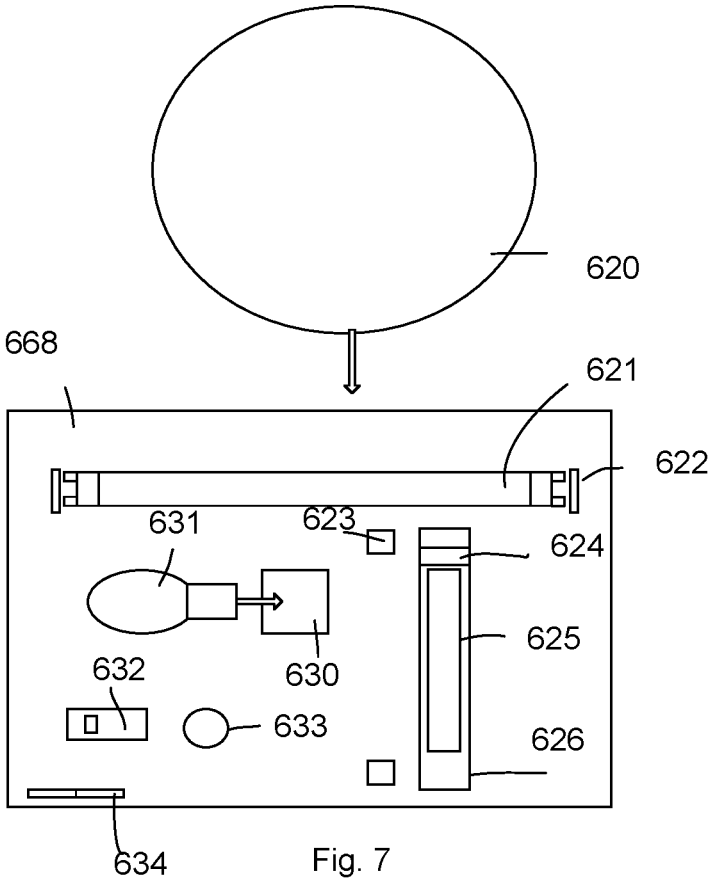
FIG. 7 shows another embodiment of a panel light embodiment.

In FIG. 7, the manual switch has a rotation switch 633 and a discrete switch 632.

The rotation switch 633 is used for changing a continuous value and the discrete switch is used for setting a discrete value.

For example, the rotation switch 633 is used for a user to adjust a maximum light intensity. Even the light source may output to a first light intensity, users may have some concern like energy saving or light effect, the light intensity may be decrease to a desired level. The rotation switch 633 may be used to set a continuous value within a range.

In contrast, the discreate switch 632, e.g. a sliding switch, may be used for assigning a working mode, a color temperature or other parameter among several candidate discrete values.

In some embodiments, the manual switch is concealed by the light passing cover. For example, the manual switch is placed upon the driver or on the base plate concealed by the light passing cover.

In FIG. 6, the base plate 656 has multiple light grooves 614 for disposing multiple light strips 615 of the light source.

In FIG. 6, the light groove has a reflective surface 661.

In FIG. 6, the light strip 615 has an electric insulation surface 662.

In some embodiments, the electric insulation surface 662 includes a lens 663 for diffusing a light of the light strip 615.

In some embodiments, the driver detects a number of connected light strips to automatically adjust an operation parameter. For example, users or manufacturers may install a desired number of light strips and the driver detects the number of the light strips to determine how to generate corresponding driving currents.

In some embodiments, if the driver detects a failure light strip, the driver turns off the failed light strip and increases light intensities of other light strips.

In some embodiments, the light source has multiple light strips.

In FIG. 7, the light strip 626 has an internal driver 624 and a LED module 625.

The internal driver 624 generates a separate driving current to the LED module 625.

In some embodiments, the base plate has multiple light strip connectors 623 for attaching the light strip 626.

In some embodiments, the frame and the light passing cover are integrated as a replaceable module to be replaced by a user. For example, the frame is made of aluminum or other metal material while the light passing cover is made of a transparent material. The frame is fixed to the light passing cover, e.g. via glue or screws. The frame and the light passing cover may be easily detached from the base plate by rotating the rotation units in a release mode. Users may replace the original frame and light passing cover with another frame with another light passing cover.

In some embodiments, the fame has a different geometric shape as the base plate.

For example, in FIG. 6, the base plate 668 has a rectangular shape while the frame with the light passing cover has a circular shape. The rotation units are placed to align with corresponding attaching units to perform the assembly of the frame 620 with the light passing cover with the base plate 668.

In some embodiments, the base plate 668 has multiple traditional light tube 621 connectors for selectively connecting traditional light tubes as the light source or light strips with LED modules on the base plate as the light source. For example, an A8 socket 622 is placed on the base plate 668 to insert a traditional A8 light tube 621 or a A8 LED light tube.

In some embodiments, the base plate 668 has an Edison socket 630 for connecitng a light bulb 631 with an Edison plug.

In some embodiments, the driver turns off electricity when the rotation units are placed in the release mode. For example, the rotation unit has a switch to send a signal to the driver to deactivate the power supply when the rotation unit is in a release mode. With such design, users may be kept safe on detaching the frame from the base plate.

In FIG. 7, a temperature indicator 634, like a temperature sensor sticker that changes color under different temperature, is placed on the frame for indicating an alarm message when a working temperature is higher than a threshold.

Please refer to FIG. 1 to FIG. 4, which show another embodiment. In FIG. 1 to FIG. 4, the same reference numerals refer to the same components and may not be repeated again when describing each drawing.

Figure 1:
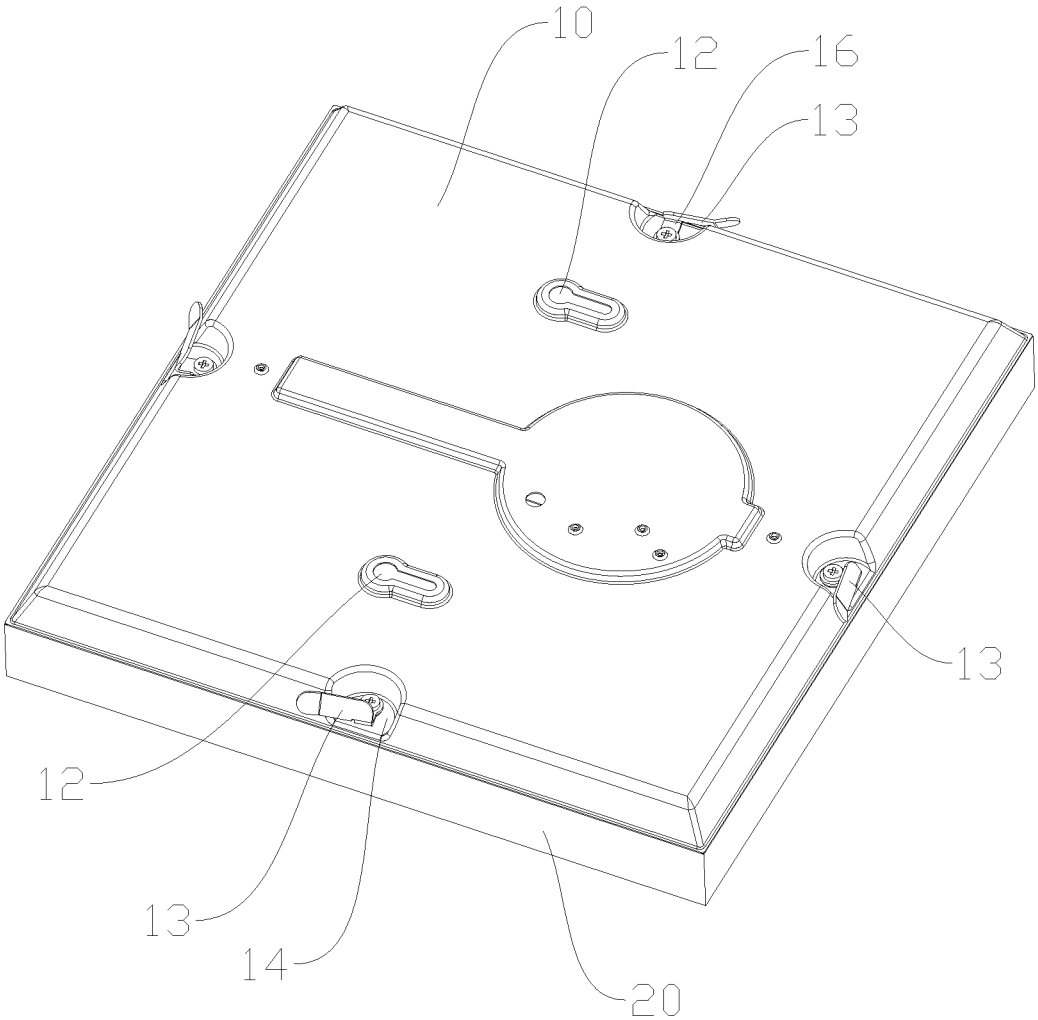
FIG. 1 illustrates a top view of a panel light apparatus embodiment.

In FIG. 1, the panel light apparatus has two installation holes 12 as the fixing units to be fixed to a ceiling or a bracket.

There are multiple rotation units 13 to be switched between a lock mode and a release mode. In the lock mode, the rotation unit keeps the frame 20 fixing to the base plate 10. The rotation unit 13 is placed in an installation groove 14. There is a connection plate 16 fixed to the rotation unit 13. The rotation unit 13 may have a handle to be rotated.

Figure 2:
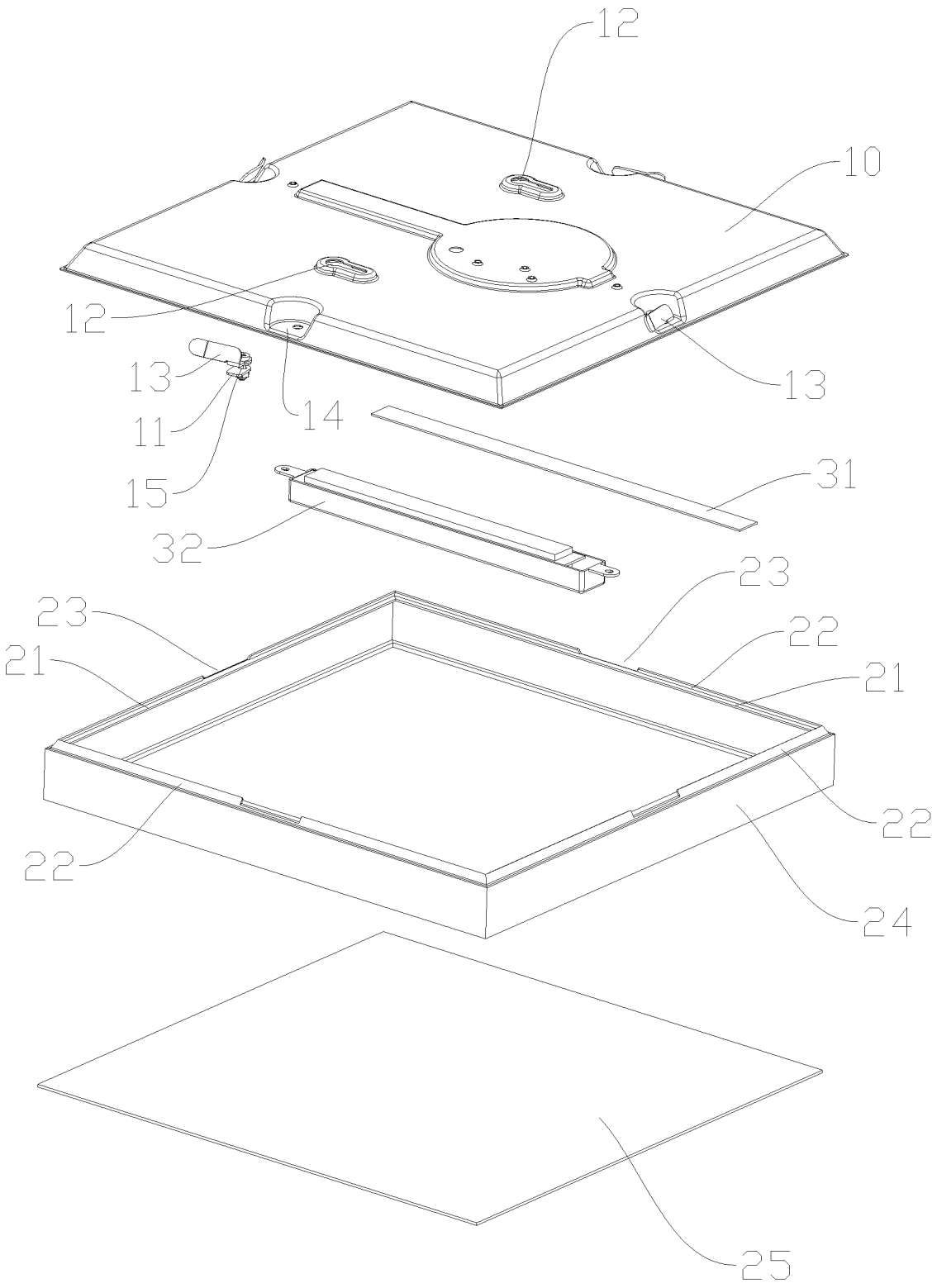
FIG. 2 illustrates an exploded view of a panel light apparatus embodiment.

FIG. 2 shows an exploded view of the example in FIG. 1.

In FIG. 2, there is rotation shaft 15 and a locking unit 11 placed on the rotation unit 13. There is a driver 32 placed inside the containing space between the base plate 10 and the frame wall 24. The frame wall 24 has guiding protruding structures 22 facing to the base plate 10. There is an escape groove 23 to align with the rotation unit 13. There is a support plate 21 for fixing to the base plate 10.

There is a light strip 31 fixed to the base plate 10. A light passing cover 25 is fixed to the frame wall 24.

Figure 3:
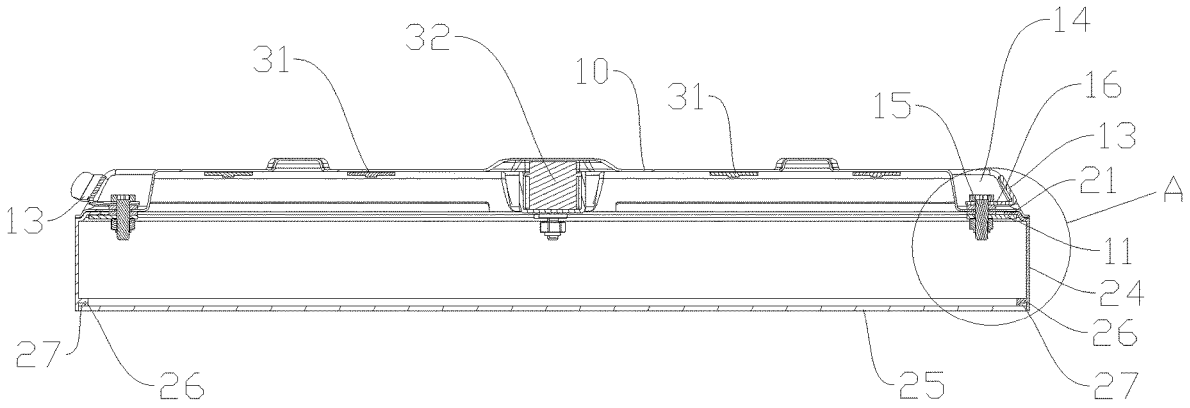
FIG. 3 illustrates a cross-sectional view of the example in FIG. 1.

FIG. 3 shows a cross-sectional view of the example in FIG. 1.

In FIG. 3, the light passing cover 25 is fixed to the frame wall 24 with glues 27 on the glue groove 26.

Figure 4:
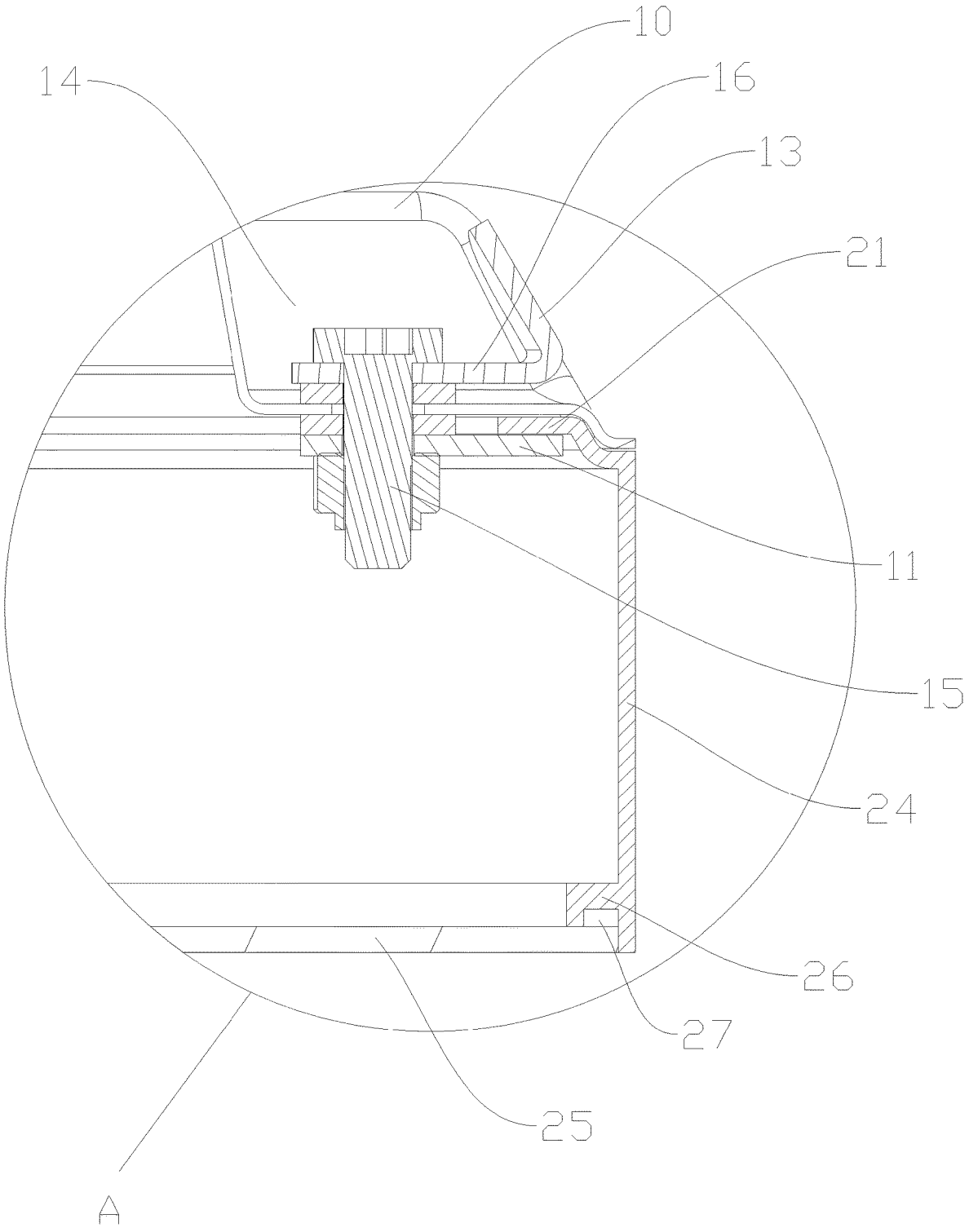
FIG. 4 illustrates a zoom-up view of a connection of components in the example of FIG. 1.

FIG. 4 further provides a zoom-up view to show the relation among the components mentioned above.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A panel light apparatus, comprising:

a base plate with a fixing unit for fixing the base plate to a platform, wherein the base plate has multiple rotation units to switch between a lock mode and a release mode;

a light source disposed on the base plate;

a frame with multiple attaching units to attach to the rotation units in the lock mode for fixing the frame to the base plate, wherein the multiple attaching units are released from the rotation units in the release mode, wherein the frame has a light opening;

a light passing cover attached to the frame for covering the light opening for a light of the light source to pass through;

a driver, wherein the light source comprises multiple light strips, wherein if the driver detects a failure light strip, the driver turns off the failed light strip and increases light intensities of other light strips.

2. The panel light apparatus of claim 1, wherein the base plate has a central groove for holding the driver.

3. The panel light apparatus of claim 2, wherein the base plate has a conductive path and a driver connector, wherein the driver is connected to the driver connector to electrically connected to an external power wire, wherein the external power wire and the driver are placed on opposite sides of the base plate.

4. The panel light apparatus of claim 2, wherein the driver has a manual switch for changing a setting of the driver.

5. The panel light apparatus of claim 4, wherein the manual switch has a rotation switch and a discrete switch, wherein the rotation switch is used for changing a continuous value and the discrete switch is used for setting a discrete value.

6. The panel light apparatus of claim 4, wherein the manual switch is concealed by the light passing cover.

7. The panel light apparatus of claim 1, wherein the base plate has multiple light grooves for disposing the multiple light strips of the light source.

8. The panel light apparatus of claim 7, wherein the light groove has a reflective surface.

9. The panel light apparatus of claim 7, wherein the light strip has an electric insulation surface.

10. The panel light apparatus of claim 9, wherein the electric insulation surface comprises a lens for diffusing a light of the light strip.

11. The panel light apparatus of claim 7, wherein the driver detects a number of connected light strips to automatically adjust an operation parameter.

12. The panel light apparatus of claim 1, wherein the light strip has an internal driver and a LED module, wherein the internal driver generates a separate driving current to the LED module.

13. The panel light apparatus of claim 12, wherein the base plate has multiple light strip connectors for attaching the light strip.

14. The panel light apparatus of claim 1, wherein the frame and the light passing cover are integrated as a replaceable module to be replaced by a user.

15. The panel light apparatus of claim 1, wherein the frame has a different geometric shape as the base plate.

16. The panel light apparatus of claim 1, wherein the base plate has multiple traditional light tube connectors for selectively connecting traditional light tubes as the light source or light strips with LED modules on the base plate as the light source.

17. The panel light apparatus of claim 1, wherein the base plate has an Edison socket for connecting a light bulb.

18. The panel light apparatus of claim 1, wherein the driver turns off electricity when the rotation units are placed in the release mode.

19. The panel light apparatus of claim 1, wherein a temperature indicator is placed on the frame for indicating an alarm message when a working temperature is higher than a threshold.

* * * * *